United States Patent [19]

Fischer et al.

[11] Patent Number: 5,072,428

[45] Date of Patent: Dec. 10, 1991

[54] MEASURING THE MISS DISTANCE OF PROJECTILES

[75] Inventors: Herwig Fischer, Willich; Klaus Matjasic, Schwalmtal, both of Fed. Rep. of Germany

[73] Assignee: Rhein-Flugzeugbau GmbH, Monchen-Gladbach, Fed. Rep. of Germany

[21] Appl. No.: 541,925

[22] Filed: Jun. 21, 1990

[51] Int. Cl.[5] ..... G01S 3/80

[52] U.S. Cl. ..... 367/127; 367/906

[58] Field of Search ..... 367/127, 906, 907, 902; 273/372, 360

[56] References Cited

U.S. PATENT DOCUMENTS 4,425,500 1/1984 Knight et al. ..... 367/906

*Primary Examiner*—Daniel T. Pihulic

*Attorney, Agent, or Firm*—R. H. Siegemund

[57] ABSTRACT

The miss distance of a projectile aimed towards a target is determined by a line of pressure transducers other than microphones which through response to a sudden pressure change together establish a cone section through a passing Mach cone; and the time space analogies of that cone permits reconstruction of the projectile path being in effect the axis of that cone.

7 Claims, 3 Drawing Sheets

MEASURING THE MISS DISTANCE OF PROJECTILES

BACKGROUND OF THE INVENTION

The present invention relates to ascertaining the miss distance of firing upon stationary or moving training targets, under utilization of the compression or shock waves of passing projectiles, whereby particularly the method as well as equipment for carrying out the method is the subject matter of the invention.

It is known generally to measure acoustically the distance by which a projectile aimed at a target either a resting i.e. a stationary target or a moving training target, has missed it. The target may have moved with subsonic speed. Projectile aimed at a target usually moves with supersonic speed and produces a conically spreading shockwave. This shockwave and its passage is detected at measuring points under utilization of microphones. The pressure and shock wave production point as far as the projectile path is concerned as well as the amplitude and/or the duration of the shockwave is used for measuring the miss distance. This method of measuring the distance is however not very reliable for moving targets particularly on account of the vector relation between the projectile speed, the target speed and the shockwave as it propagates. In fact, a correct result will be ascertained only in cases of peculiar coincidences among these vectors.

German printed patent application 31 22 644 discloses a method and equipment for acoustically measuring the miss distance as between a projectile and a flying target, and attempts have been made as per this reference to avoid the errors outlined above. Specifically, the method as disclosed there attempts to measure the strength of the shockwave pressure produced by the passing projectile which measurement is carried out by the target itself and the measuring result is transmitted to equipment on ground.

Based on predetermined parameters the distance between projectile path and target is ascertained at the instant of passage which in effect is the shortest distance between target and projectile. This obtains by ascertaining the period of duration of the pressure wave as it affects the target, and the angle between target trajectory and projectile trajectory. These values are then used to calculate the true distance between target and trajectory under utilization of a correcting factor. The accuracy of the measurement is dependent on the accuracy of predetermined parameters. Since a pressure wave is measured by means of microphone the so called "bang" effect influences the measurement and it is well known that problems arise when pressure by means of microphones.

European patent 0003095 suggests an expansion of the method mentioned above but now under utilization of five microphones whereby 4 microphones are arranged in the corners of a polyhydron or "tetra" This arrangement permits not only the quantitative measurement of space and distance information between projectile path and target but the directional information is also available in this way. However, this method is subject to the following problems.

The configuration of the pressure or compresssion shock wave produced by the passing projectile is dependent on numerous operating parameters such as the type and configuration of the projectile, its distance, target speed and angle of directing the projectile so that any kind of combination requires separate calibration; numerous parameters enter into the picture and the situation is quite difficult. The same is true with regard to the correction needed for and in the evaluation by means of processing equipment during real time operation. On the other hand it has to be considered that changes in the configuration of the pressure wave as it spreads is very difficult to ascertain by way of calculation so that an evaluation requires numerous very extensive and expensive calibrating procedures, for obtaining particular wave contours as reference under various different conditions of operation; also, there is a need for cyclically repeated calibration.

The ascertaining of the pressure wave configuration by means of a microphone is interfered with through a large number of interfering sources such as noise, temperature variations and particularly the case of relatively high target speeds, these factors become increasingly noticeable. Also, the conversion of information under consideration of the Doppler effect and certain properties of the microphone are difficult.

DESCRIPTION OF THE INVENTION

It is an object of the present invention to provide a new and improved method by means of which the miss distance as between a projectile and a training target can be ascertained with great accuracy whereby particularly the utilization of microphones is avoided so that as far as the pressure and shockwave is concerned, only the info on the passage of the pressure wave front is to be used.

In accordance with the preferred embodiment of the present invention, it is suggested to provide a plurality of transducers and arranging them at least approximately, on a straight line. This group of sensors will cut through the pressure wave emanating from the passing projectile in that the temporally variable pressure acts as trigger pulses for triggering transducers as the shockwave passes. This way an intersecting hyperbola of the Mach cone of the passing projectile, is ascertained. One needs at least three points. This, however is just a theoretical minimum requirement concerning the acquisition of data defining hyperbola. In reality and for reasons of accuracy one should use many more.

Therefore the present invention suggests a completely new approach of acquiring data on a passing projectile. One uses basically very simple pressure sensors which are arranged in a line arrangement i.e. they are strung along a linear carrier and form a straight line. This linear arrangement of a sensor group or transducer array just responds to the passage of a wavefront in that each sensor or transducer just produces an onset-of-pressure change pulse namely when being triggered by the passing shockwave front. Therefore, one obtains a plurality of basically independently produced and temporally differing pulses. The geometry involves consideration that this measurement is equivalent to the "cutting" through the Mach cone i.e. one does in effect ascertain a cone section which of course has different configurations depending on the plane of cutting and intersection. Usually that cone section will be a hyperbola.

Therefore the configuration of the shockwaves itself as it is produced by supersonic projectiles is no longer the subject to measurement. In other words, it is avoided to extract distance information from absorption patterns. This would require microphones as is known for ascertaining the configuration of the shockwave, particularly as produced by the front and rear edges of the projectile. As far as the invention is concerned all these known or supposedly known complex relations between shockwaves configuration and its modification such as reduction of amplitude with increasing distance, difference in that reduction as between the different kinds of shockwaves produced by head and tail of the projectile, all contain changes with increasing propagation time and distance from the point of origin; but they are all factors which are no longer of importance since one intentionally is not interested any longer in obtaining directly the distance, that is a desired distance value between some kind of sound sensor (microphone) and the closest point of projectile's trajectory on the basis of shockwave configurations. The approach taken by the invention involves multiple measurement of pressure onset by means of simple sensors and transducers is basically different, as the goal no longer the configuration of a shockwave in any particular point, the goal is to ascertain a cone section from which to reconstruct the Mach cone as it passes with the passing projectile.

The pressure sensors and transducers that can be used here for practicing the best mode of the invention can be extremely simple and are quite economical without requiring any particular thrills and exotic properties. All that is required is that they provide some form of recognizable signal when a pressure compression shock wave passes which is sufficiently discernible and separable from ambient noise. These signals, particularly a leading edge, is used as a trigger whereby of course the timing of triggering by the different transducers is the composite set of factors that relate to the geometry of the hyperbola.

One can use very simple piezomembranes as pressure sensors and transducers. Owing to the intentional economy involved in the choice of the individual pressure transducers and sensors one can and should use many of them. Ultimately the cost factor may be the same. In other words there is a tradeoff of using many cheap transducers rather than a few expensive microphones, but ultimately practicing the invention is more economical and more accurate and more reliable because the sensor assembly can be placed much closer to the target position without incurring losses.

Considering some aspects in greater details, as stated the line of sensors or transducers cuts through the Mach cone of a projectile resulting in a particular conic section. In the present case specifically the cut and intersection occurs in the direction of the cone that is in the direction of the axis of the cone, so that as a consequence and based on elementary geometry the cone section is a hyperbola indeed. In the special case of a full hit of a stationary target, the hyperbola degenerates into a pair of straight lines. In the case of a movable target and of a full hit there is an imaginary image. This image results also in all cases where the cutting angle is not equal to 90 degrees.

If a straight line of pressure transducers is intersected by a Mach cone of the projectile the individual transducers will be triggered one at the time by the shockwave front of the Mach cone, as that cone becomes wider and wider, and this sequential intersection is of course reflected in temporal staggering of trigger pulse production. The delay in triggering between the adjacent transducers, under consideration of the known distance between them, the configuration of the cone section can in fact be ascertained. They are in all cases hyperbolas or affine transformations thereof.

A hyperbola is characterized by a mathematically defined configuration which means that three points are sufficient to determine the coefficience of such a hyperbola. Of course, as stated above one should have many more simply to eliminate tolerances and inaccuracies in the measurement. Once the hyperbola is known the disposition of the Mach cone and the distance of the cone axis from the line of transducers can easily be calculated. However, there is an inherent ambiguity on account of the symmetry involved; the projectile may have passed to one side or the other side of the transducer line. By using another pressure transducer, off the line of transducers one can indeed resolve that ambiguity and determine the disposition of the projectile's path.

In case the training target is a moving one, and of the intersection angle between the line of transducer and the trajectory is unequal to 90 degrees, one needs a mathematical transformation of the affine transformation of the original hyperbola back to the original hyperbola, under consideration of scale and under further consideration of the speed of the training target. The relative speeds of target projection can be ascertained through triangulation of Mach numbers.

The inventive method has the following advantages over the known procedures. First of all one does use nor even expensive microphones so that all problems inherent in the use of such microphones are avoided. Rather one uses simple pressure transducers which are considerably less expensive and can be used therefore in large numbers, even in those areas which in those cases whereupon a hit then will be lost. Rather than ascertaining the configuration of a pressure wave produced by the passing projectile one determines in a much more accurate fashion the cone section of the Mach cone that propagates from the projectile. The cone section results from the fact that the line of sensors cuts through the Mach cone and one simply needs the initial rise in pressure as determined by the individual transducers as the instant of passage of the line through the cone. There is no special requirement concerning the transmission of the measuring signal from the transducers to the evaluating unit. Certain calibrations e.g. cyclic calibration and predetermination of certain parameters is not necessary.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a line of sensors, the sensors being individual pressure transducers 2. These passes transducers are strung on a carrier cable or the like that is suspended from a training target or the like such as moving aircraft AC. This line 1 of transducers 2 is passed by a projectile 6, which of course moves at supersonic speed, issuing and from the passage shockwave emanates to a Shockwaves issue from the projectiles so that a Mach cone 7 emanates therefrom. The line 8 in FIG. 1 is hyperbola which is the intersection of the cone 7 with the sensor line 1.

Figure 1:
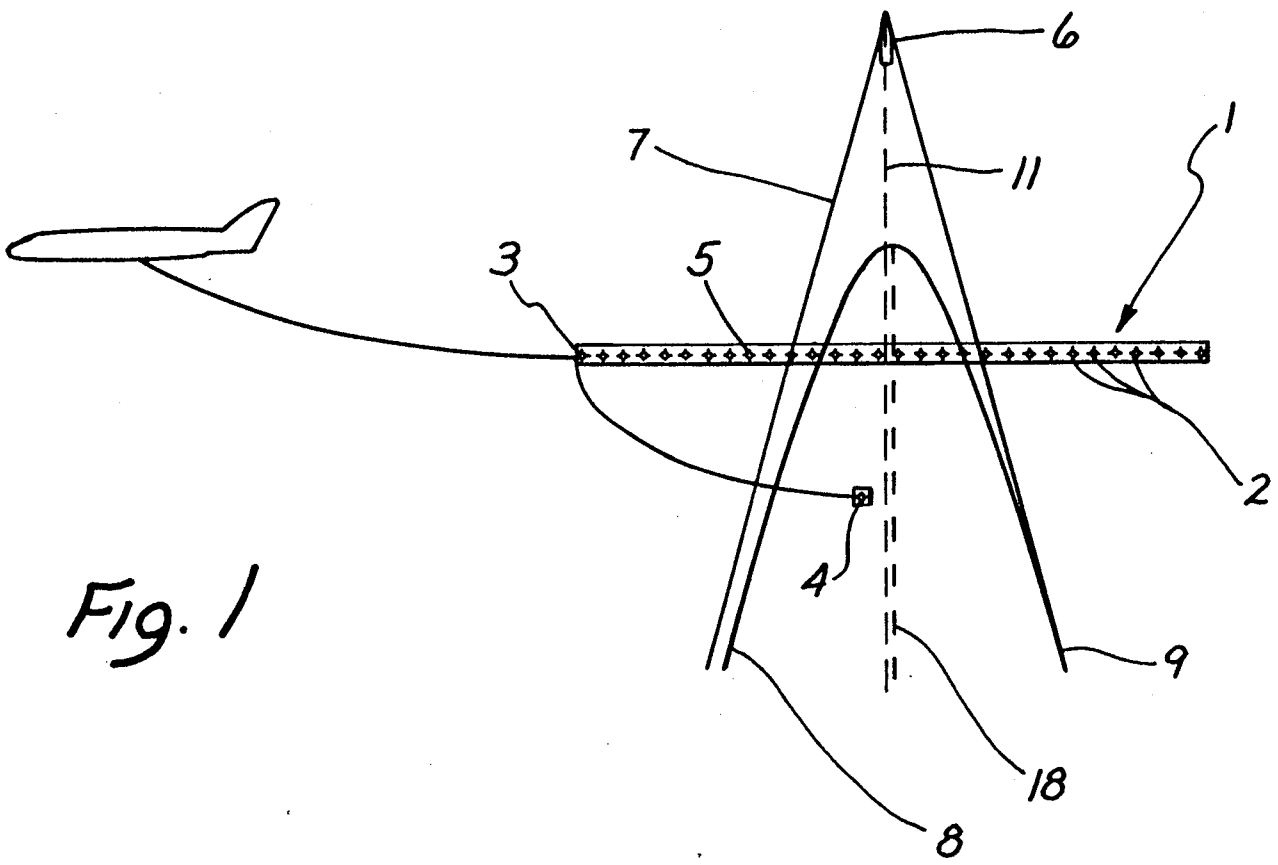
FIG. 1 is a somewhat schematic view of a line of sensors or transducers in accordance with the preferred embodiment of the present invention for practicing the best mode thereof in determining a cone section of a Mach cone.

The cone 7 has a center axis 11. If we assume that the line 1 of transducers 2 is actually situated in the plane of the drawing then the cone, i.e. the cone's axis is off that plane and the line 8 is in effect the cone section produced by the MACH cone 7 as it intersects the plane of the drawing.

Figure 2:
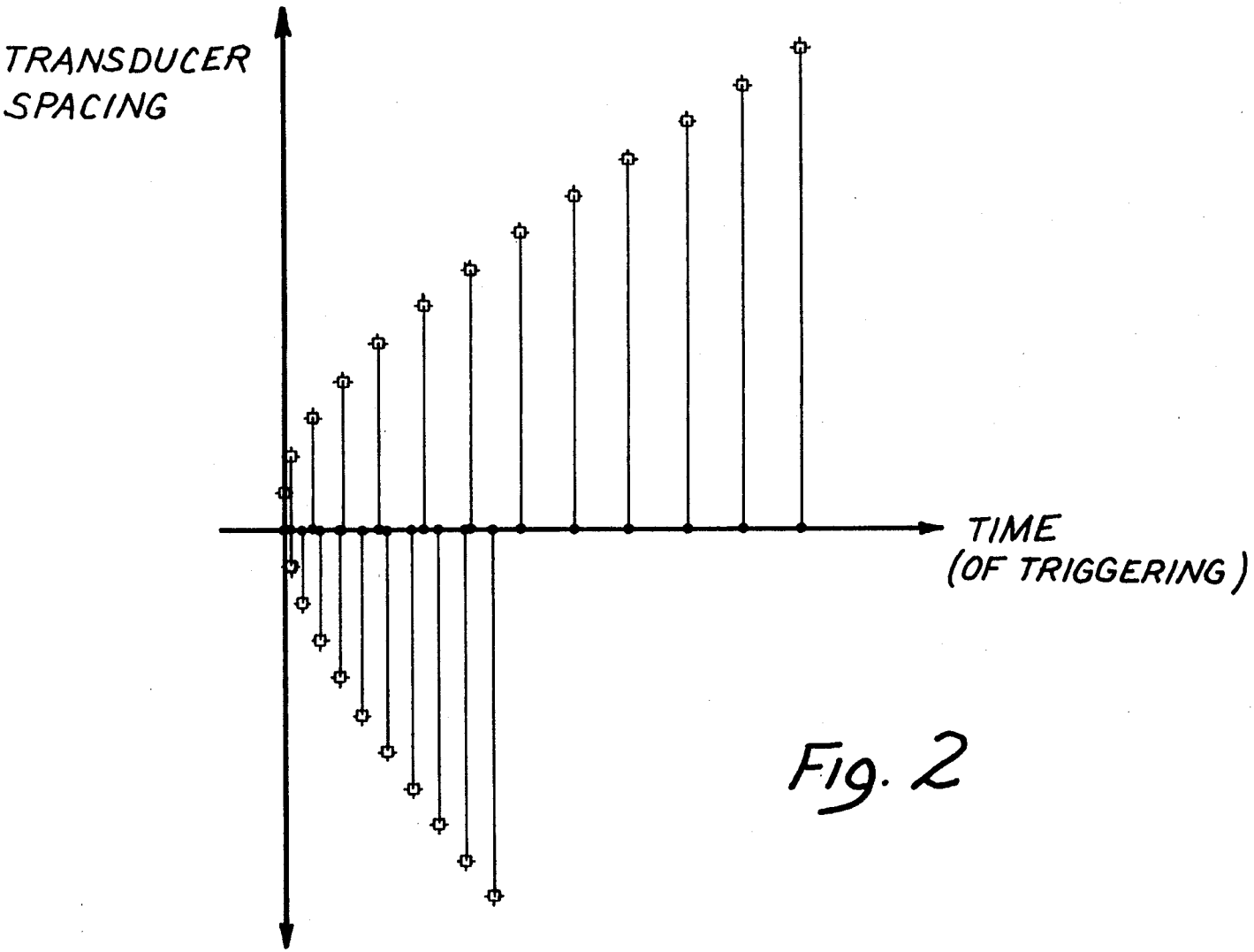
FIG. 2 is a transducer response vs time diagram for reconstructing the hyperbola that results for a cone section wherein the transducer line shown in FIG. 1 cuts through the Mach cone of a passing projectile.
Figures 3A, 3B:
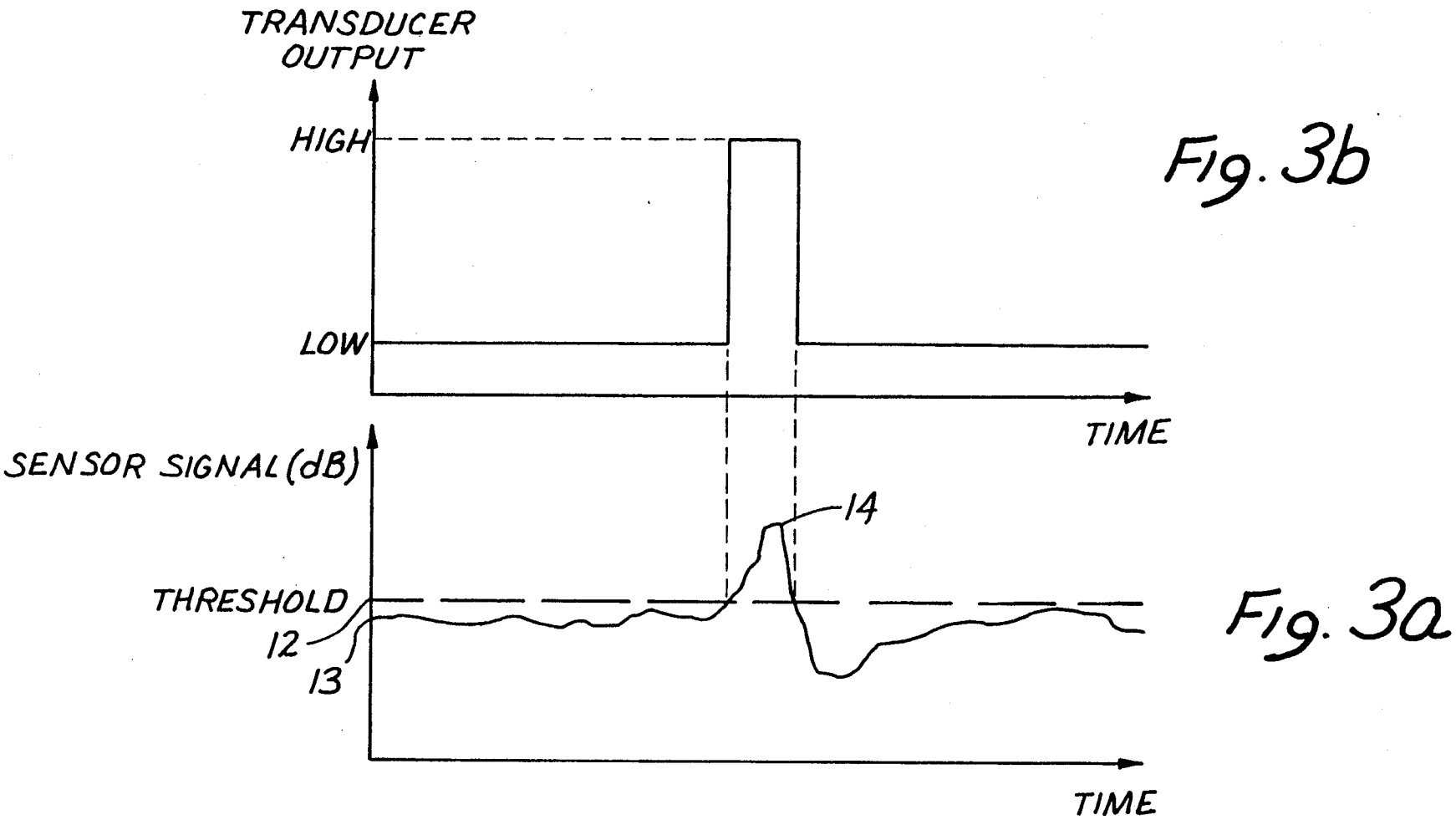
FIGS. 3*a* and 3*b* are signal and pulse vs time diagrams concerning the production of an output of individual one of these sensors and transducers.

FIG. 2 illustrates how the hyperbola 8 is reconstructed from the instant of triggering of the individual sensors 2 and transducers of the line 1. The line of triggering is the result of comparing the times of triggering of various transducers 2 with each one. The transducers 2 each provide a pulse when passed through by the Mach cone, and this occurs, as per FIG. 3*c* by determining that a particular pressure threshold value 12 being e.g. 68 dB is exceeded. That level must be located sufficiently above the noise level which is normally provided. FIG. 3*b* shows the transducer output on account of a sensor signal 13 exceeding the threshold 12.

There is a trade-off between the lowest reasonably ascertainable Mach cone shockwave, and the highest noise level resulting from the fact that the target AC is in the vicinity of the transducers. (Noise of the aircraft engines etc.) The threshold 12 therefore must be selected to be above the normal noise level 13 and well below a typical projectile noise level such as the peak 14.

The pulse issued by a transducer together with some form of identification of the transducer i.e. its relative position in line 1 of transducers is transmitted to evaluating units e.g. on board of the aircraft or on ground. The timing of all pulses is then used in a computer to reconstruct the section hyperbola in accordance with FIG. 2. Owing to a large number of transducers used in the line 1 the hyperbola or its affine image 8 is well known. The branches approach asymptotic lines so that the relative position of the Mach cone 7 at the time of passage, including particularly the axis 10 of the hyperbola in relation to the axis 11 of the cone can be calculated. The desired distance value is now the distance between these two axes from each other.

Having done these calculations one can easily determine the angle between the line of transducers and the path of the projectile. In FIG. 1 it is moreover arbitrarily assumed that the transducer 5 within the line 1 of transducers 2 establishes the center of the target so that in addition to the distance between the two axes 10 and 11 from each other, the distance of the axis 10 from this transducer 5 is a factor for determining the projectile path distance from the center of the target as thus defined. In addition of course the geometry to be considered requires the consideration of the relative speed of the line 1 in relation to the mach cone and its axis 11. The motion of the target is of course colinear with the line 1 but as a specific point of reference one can consider the motion of the target to be the motion of the transducer 5. In the case of moving targets therefore before and behind and behind as taken in relation to the movement of the target 5 is to be considered to the left and right consideration as far as the axis 11 is concerned.

In addition a supplementary transducer 4 is provided outside of the horizontal and of the vertical plane in which line 1 lies to determine the disposition of the cone above or below the line of sensors and transducers, as well as to the left and to the right. Several out-of-line transducers can be used, particularly to increase certainty through redundancy.

The moving of a training target as per in FIG. 1 and as illustrated here, is established by a towing cable C extending from aircraft AC from which the line of sensors 1 is thus suspended. The towing action involves specifically moving the particular transducer 5 which is so to speak the target proper and the transducers 2 in front and behind are then the instruments by means of which the cone section of the miss is ascertained. In this case the intersection hyperbola 8 is an affine image or transformation of an original hyperbola. This affine image requires a retransformation into the original hyperbola, and only then is it possible to determine the miss distance. The determination of target speed and of projectile speed as function of the Mach number is the result of forming a so called Mach number triangle.

Another transducer 3 in front of the line is not a pressure transducer but is representative of measurement of supplemental parameters in the region through which the line of transducers passes. Transducer 3 measures the temperature. This is an important feature since the speed of sound varies with temperature and one can now provide an adequate correction in the speed determination and in the meaning of the Mach cone in terms of absolute speeds of each and both projectile and target. Another parameter of course is the elevation of the target above ground which is so to speak the vertical distance from the gun firing the projectile.

Moving training targets are usually dragged or drawn devices which are pulled by means of a drag cable C under utilization of the aircraft AC as illustrated. The line of sensors and transducers forms one long line as it traverses the plane across the training ground and will of course project at least from one end or one point of the transducer (5) defining the target proper.

The line of sensors is preferably integrated into the drag cable. Strictly speaking in the example shown in FIG. 1 the target is the point, namely the location of the transducer 5 and that is also a representation of the center of a target. In addition of course several transducers are situated in front and others are behind that transducer 5 and they too can be associated physically with the length of the target and are identified therewith. This is in addition to the function of the line of transducer as "hyperbola cutters".

If one wants to have a still more realistic 3D approach to target simulation several of these lines of transducers can be used and they together define a 3D configuration. They may be running parallel or through appropriate spacers could be arranged at an angle to each other. In lieu of such a multiple line arrangement one should consider a drag body like a sac or the like which carries two or more lines of sensors. If two or more lines of sensors are used then the supplemental transducer 4 is no longer necessary.

For mathematical reasons the term "line of transducers" requires at least three pressure transducers arranged on a line. This is the minimum for ascertaining a cone section. Of course the accuracy with three transducers will not be very high but in simple cases it is conceivable that the accuracy from using just three transducers may suffice. The number of transducers used in this cone cutting line and the spacing between them are not the only parameter that determine the accuracy from the passing projectile. Obviously, the more transducers are available on one hand, and the closer they are spaced on the other hand the more accurate will be the result. The transmission of the pulses monitored by each transducer is relatively simple. In the kind of example shown in the drawing there are simply wires that are integrated in the towing cable C and then the usual on-board facilities on the craft AC take over. The processing of the signals may be carried out immediately by an on-board computer equipment or there is a transmission to ground. There is the choice of transmitting processed or unprocessed data to ground or one may not even need transmission to ground but evaluate whatever result obtains by an onboard processor for use in subsequent study sessions.

It is advantageous to provide immediately on board analog-to-digital conversion of the transducer signals in order to obtain digital signals right in the beginning which of course includes also the ascertaining of times of relative trigger times of the various transducers. As stated, the processing facility may either on board or on ground or both and may include display indications as it may be desirable to have immediately the measuring result visually available; how far did they miss the target, conceivable the trajectory may be displayed in a 3D fashion including target positions and identifications in various forms. All this may ultimately result in statistical evaluations of the process, particularly if one projectile after another is fired at the target.

The invention is not limited to the embodiments described above but all changes and modifications thereof, not constituting departures from the spirit and scope of the invention, are intended to be included.

We claim:

1. Method of ascertaining the miss distance between an airborne training target and a projectile trained towards the target comprising steps of using at least one line arrangement of a plurality of at least three pressure transducers which line "cuts through" a Mach cone shockwave resulting from a passing projectile, the line arrangement being on a line that is at least approximately a straight line;

determining for each individual transducer on account of its pressure response the time of passage of that transducer through the Mach cone;

reconstructing from the temporal relations of the triggering of the transducers a hyperbola as cone section in representation of a Mach cone as it passes the line arrangement of the transducers to determine the distance of the axis of the Mach cone from the line of transducers; and using at least one supplemental transducer, outside of the line of transducers for further determining the relative position of the axis of the Mach cone as representing the path of the passing projectile.

2. Method as in claim 1 and including the step of using piezo-membrane transducers.

3. Method as in claim 1, including additionally measuring the air temperature where the line passes through.

4. Method as in claim 1, using plural lines of transducers.

5. Method as in claim 1, wherein a centrally situated transducer of the line of transducers serves as target center.

6. Method as in claim 1 including in addition measuring at least one supplemental parameter.

7. Method as in claim 6 including measuring ambient temperature in the region through which the line of transducers passes.

* * * * *